United States Patent [19]

Hirata

[11] 4,328,922

[45] May 11, 1982

[54] ARTICLE CARTON WITH SEPARATING PARTITION

[75] Inventor: Seiichiro Hirata, Mitaka, Japan

[73] Assignee: Kliklok Corporation, Greenwich, Conn.

[21] Appl. No.: 166,687

[22] Filed: Jul. 2, 1980

[51] Int. Cl.[3] ..... B65D 5/48

[52] U.S. Cl. ..... 229/27; 206/45.14

[58] Field of Search ..... 229/27, 15; 206/45.14, 206/45.31

[56] References Cited

U.S. PATENT DOCUMENTS

| | | | |
|---|---|---|---|
| 219,273 | 9/1879 | King . | |
| 1,673,975 | 6/1928 | Feigelman | 206/45.14 |
| 2,128,197 | 8/1938 | Weil | 206/45.14 |
| 2,225,991 | 6/1942 | Lester | 206/45.31 |
| 2,505,399 | 4/1950 | Hilton . | |
| 2,571,408 | 10/1951 | Bergstein . | |
| 2,867,370 | 1/1959 | O'Reilly . | |
| 3,066,843 | 12/1962 | Johnson | 206/45.31 |
| 3,642,125 | 2/1972 | Johnson | 229/27 |
| 3,682,297 | 8/1972 | Austin | 229/27 |
| 3,899,119 | 8/1975 | Roccaforte | 229/15 |

*Primary Examiner*—Herbert F. Ross

*Attorney, Agent, or Firm*—Lowe, King, Price & Becker

[57] ABSTRACT

An article carton, formed from a single sheet blank of foldable material having a plurality of fold lines forming interconnected carton forming panels, a portion of the blank having plurality of cutouts, said portion of the blank being folded to partially preform an interior article spacer and positioning partition. The carton panels are foldable at the fold lines to form an enclosed erected carton, the preformed partition in erected carton form including horizontal and vertical web portions respectively inter-engaging with panels forming the erected carton and thereby providing both partition and carton strength and rigidity. Cutouts in the horizontal web portion of the partition means receive and space the articles placed in the carton.

8 Claims, 4 Drawing Figures

ARTICLE CARTON WITH SEPARATING PARTITION

TECHNICAL FIELD

The present invention relates to an article carton and more particularly to a carton formed from a cut and scored blank of a single sheet foldable material, such as paperboard, and wherein an integral portion of the blank constitutes, in an erected and assembled form of the carton, an interior article spacing and positioning partition.

BACKGROUND ART

Cartons and carriers formed from a blank of low-cost foldable material, such as paperboard, are well known in the prior art. Typically, the paperboard blank is precut into a desired shape, and provided with a plurality of fold or score lines which facilitate formation of the blank into a desired erected carton.

Such paperboard cartons normally have special structural configurations and features to accommodate specific articles to be placed therein, and to provide appropriate positioning for safety of such articles. The blanks must be capable of relatively easy and low cost initial manufacture, and susceptible of shipment to an ultimate user in a convenient shipping condition, preferably flat. Furthermore the blanks must be easy to erect or assemble into a carton on automatic carton forming and filling production lines.

The blank to form a completed or erected carton may include a partition with cut outs to accommodate particular configurations and shapes of articles to be placed in the completed carton. Preferably the material, configuration, and construction provide for the appropriate spacing of the articles within the carton. Ease of insertion of the articles is necessary, and subsequent thereto article protection must be provided at reasonable limits of cost. In the past, it has proven difficult to provide a low-cost, easily erectable carton that accomodates a wide range of irregular bottles or other articles, and protect the bottles during handling, shipping and use by the consumer.

SUMMARY OF THE INVENTION

The present invention is broadly of the foregoing type and is designed principally for the safe containment of bottles filled with liquids. Bottles frequently have irregular external configurations, and are constructed of a relatively frangible material, such as glass.

Accordingly, it is a primary object of the present invention to provide an article carton or carrier, primarily usable for liquid containing bottles having irregular and varied external configurations. The carbon can be easily erected by the ultimate user.

The blank is of substantial significance. The blank is formed from a single sheet of foldable material and has a plurality of cutouts, fold and score lines, all so configured as to result, upon erection, in a carton for easy insertion and safe containment of such bottles. The single piece blank can be shipped to the user in a substantially flat condition, and thereafter can be readily and easily automatically erected, filled with articles and closed.

The invention, accordingly, teaches a single piece blank having features for formation of a paper-board carton for containment therein of frangible articles, such as bottles filled with liquids. The single piece blank includes, as a portion thereof, an integral article spacing and positioning partition. The partition is susceptible to preforming or pre-erection prior to shipment to the ultimate user. Upon receipt at the site of erection and filling, the carbon can be finally erected. The completed structure has strength and rigidity not heretofore provided in the art.

The improved carton or carrier incorporates a unique arrangement of foldable panels and portions. All panels and portions for forming the completed carton are formed in a single blank of paperboard and the inner surfaces of the side panels of said erected carton do permit ready erection and formation of the carton. The blank is adapted for shipment in a substantially flat, but partly preformed condition. The preformed portion provides spacing and positioning of articles, i.e. the interior partition for separation of articles to be placed therein.

The paperboard material may have a contact cement applied thereon to serve as an adhesive between the various panels and portions of the blank when erected to form a carton. Alternatively, the seal areas may be provided with separately supplied "hot melt", or similar adhesive for bonding. The blank includes, with appropriate fold and score lines therebetween, a botton panel, a rear panel, side panels, a partially open front panel, and a combined top panel and front closure flap. The interior article spacer and positioning partition is formed in the blank as a portion of the front panel and an extension thereof. The partition means is so configured that, when erected with the completed carton, it strengthens the partition per se, and the overall carton with which it is associated.

The partition is advantageously configured to permit easy insertion of the articles or bottles in the erected carton. The partition contains shapes and configurations of the articles. This positions and steadily holds the articles in the container. Various portions of the cutouts, and other partition forming areas of the blank, are adapted for strengthening engagement with interior portions of the panels of the erected carton. The articles when placed in the erected carton not only have portions thereof contacted by and with portions of the partition, but additionally contact interior surface portions of the carton. This facilitates article placement and stability within the carton.

The blank from which the carton is to be formed is relatively inexpensive to manufacture, easily shipped, and susceptible of easy final erection, placement therein of the articles such as bottles, closing and sealing of the completed and filled carton.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modification in various, obvious respects, all without departing from the invention. Accordingly, the drawings and description are to be regarded as illustrative in nature, and not as restrictive.

BRIEF DESRIPTION OF DRAWINGS

The accompanying drawings illustrate a preferred embodiment of the invention and, when taken together with the description, serve to explain the principles of the invention.

DETAILED DESCRIPTION OF PREFERRED EMBODIMENT

Figure 1:
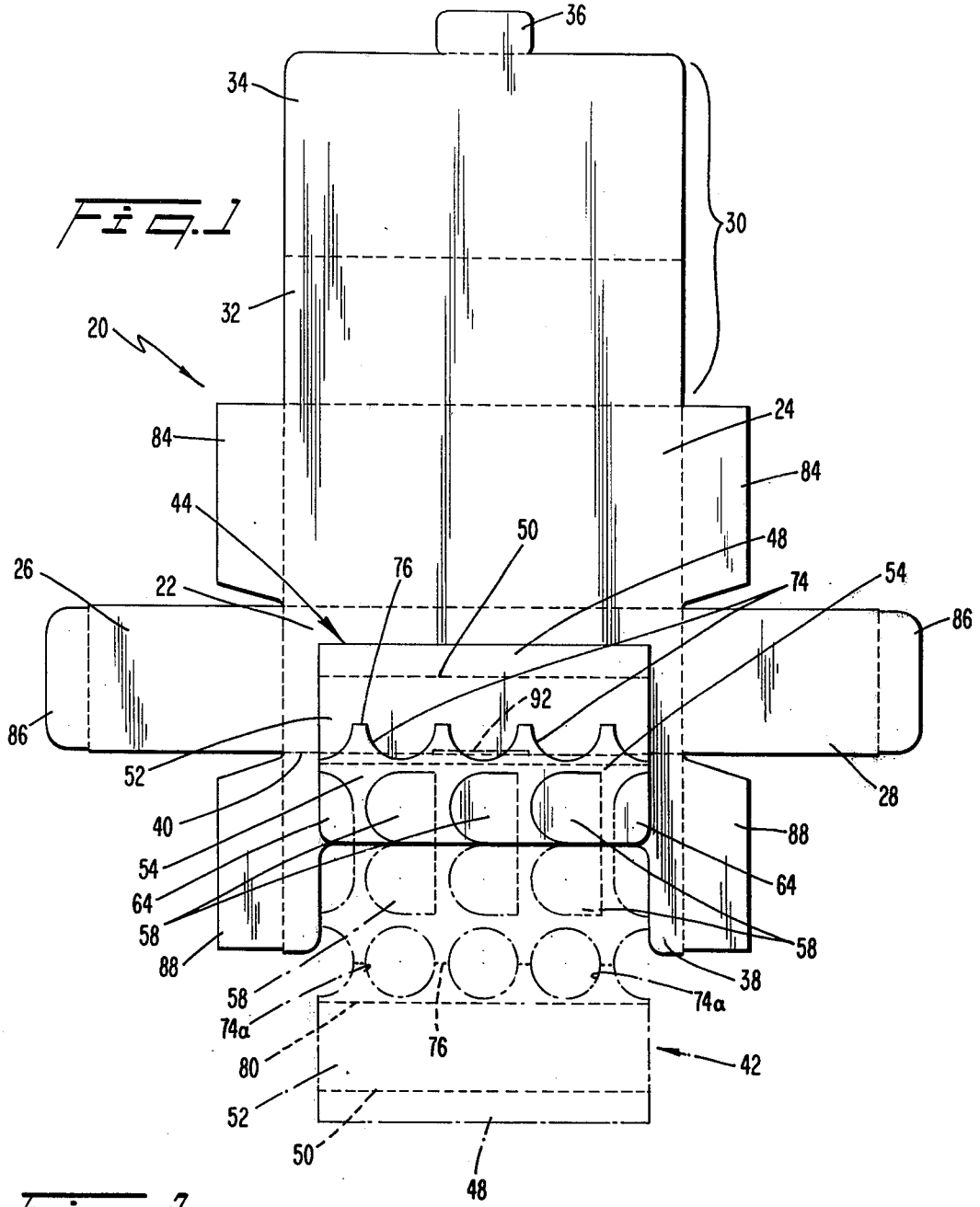
FIG. 1 is a plan view of a blank for forming the carton of the invention, a partially preformed interior partition shown in solid lines and with the blank portion of the partition before preforming being in broken lines.

Referring to FIG. 1, a paperboard carton blank, generally 20, includes a bottom wall panel 22, a back panel 24, side panels 26 and 28, and a composite panel 30 consisting of a top panel portion 32 and a front closure flap 34. A locking tab 36 extends from and beyond front closure flap 34.

A partially recessed or open face front panel 38 is attached to the bottom panel 22 by a score or folding line 40. The extending portion 42 of the front panel 38 is shown by broken lines in FIG. 1. Portion 42 is so cut and configured as to ultimately form, in the erected carton, an article spacing and positioning partition. The partition, generally designated 44, is in the partially preformed condition in FIG. 1.

The blank as initially formed is flat and the extending portion 42 in FIG. 1 includes an elongated tab portion 48, formed along a fold line 50. In the erected form of the carton the tab portion 48 is adhesively attached to the interior of the bottom panel 22. A vertical web portion or intermediate panel 52 extends from the other side of fold line 50. The vertical web portion is in the erected state positioned intermediate of said front panel 38 and said back panel 24, thus dividing the carton into basically two rows (see FIG. 4).

Figure 2:
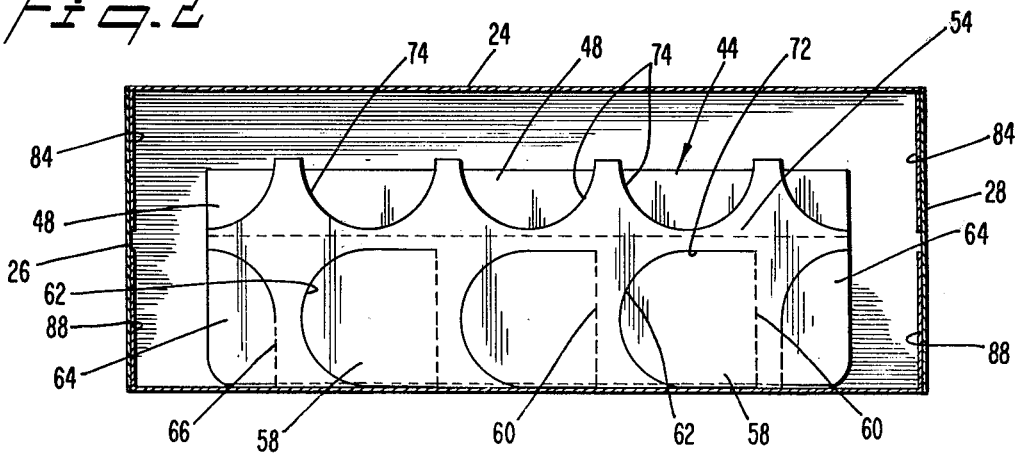
FIG. 2 is an internal cross-sectional view of the erected carton, from above, and disclosing the configuration and positioning of an article spacing partition.
Figure 3:
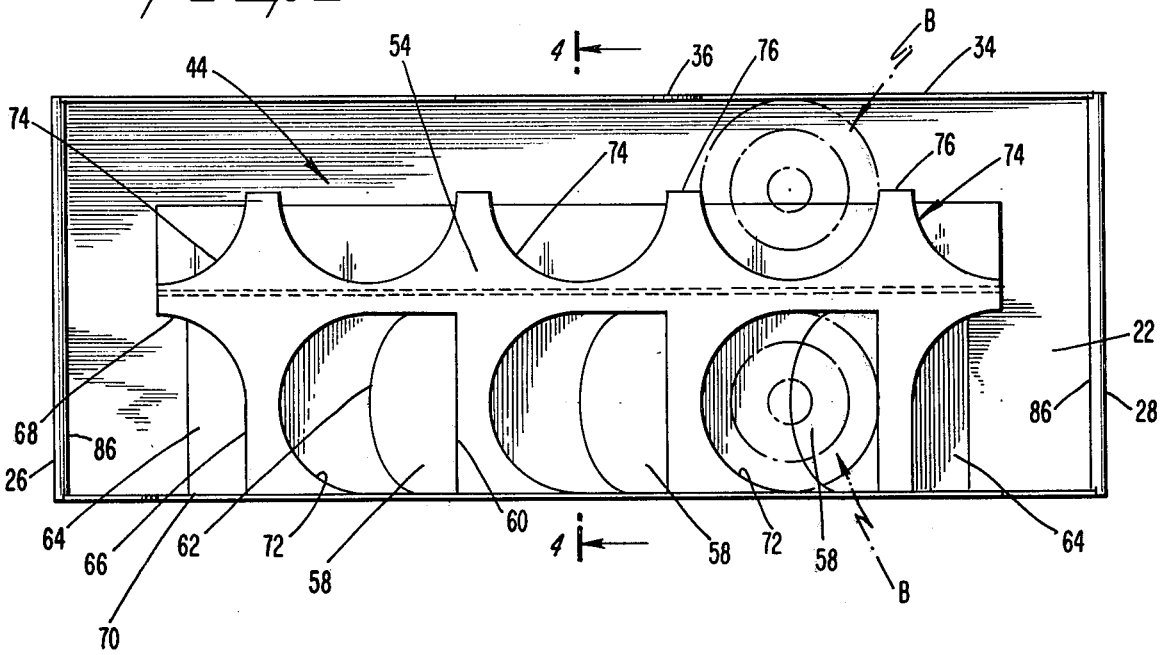
FIG. 3 is an internal top plan view of the erected carton, and schematically depicting placement of some articles therein.

The partition includes a horizontal web portion 54 having a plurality of cutout tabs 58 forming a front row article spacer. The tabs are connected along straight fold or hinge lines 60 (see FIGS. 2 and 3). The hinge lines 60 serve to permit a downward depression of the curvilinear edge 62 of the tabs 58, as shown in FIG. 3, as articles are inserted in the formed openings. At each front corner of horizontal web 54, end cutout tabs 64 are provided with hinging fold lines 66. These end cutout tabs 64 have curvilinear portions at 68, shown in FIG. 3, and rounded courners 70. Fold lines 66 are straight and each of the cutout tabs 58 has a straight or linear edge 72 along each of the side edges thereof.

The elongated intermediate edge of horizontal web portion 54, that is the edge remote from the front panel 38, has semi-circular cutouts 74, which are in substantial alignment with the cutout tabs 58. These cutouts 74 are formed by folding of the portion 42, FIG. 1, along fold score line 76 which extends through the center of the circular cutouts 74*a* (see FIG. 1).

Figure 4:
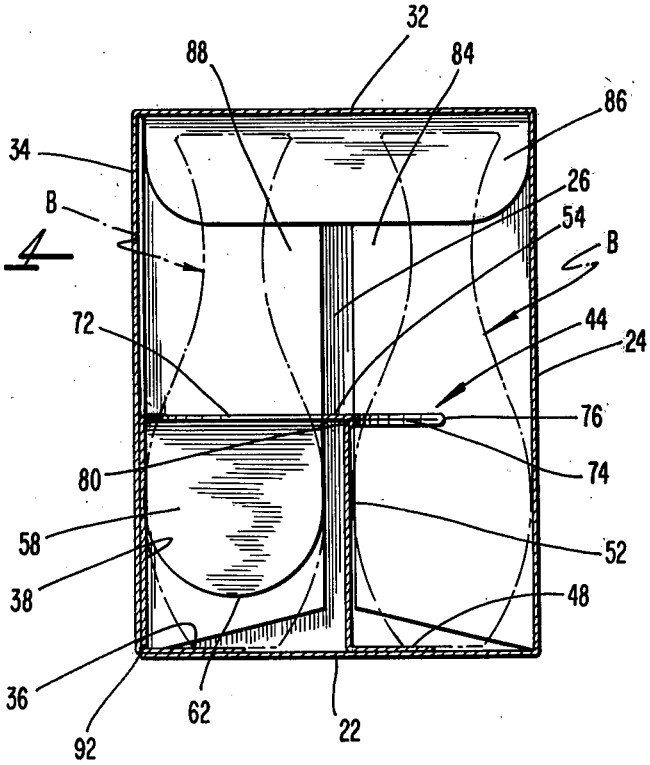
FIG. 4 is an elevational cross-sectional view taken on line 4—4 of FIG. 3, and showing in broken lines some articles in the erected and finalized container.

In accordance with the invention, web portion 54 is doubled under on itself along this line 76, as better shown in FIG. 4, to form a double layer thickness back row spacer (see FIG. 4). The vertical web portion 52 is connected to the under-folded web portion of the spacer along fold line 80. The double layers of web forming the back row spacers are adhesively attached to each other to provide extra strength and rigidity.

The blank includes foldable tabs 84 at the sides of back panel 24. In-folding and locking side flaps 86 are provided at the outer ends of side panels 26, 28. Recessed edges and rounded corners are provided on tabs 84 and side flaps 86. Side flaps 88 are provided with recessed edges for the same easy folding purpose.

The flat blank as initially formed by the paperboard manufacturer, prior to shipment to the ultimate user or erector, has the partially preformed partition 44 effected by folding the extending portion, shown at broken lines 42 in FIG. 1, to the position shown in full lines. The full line showing is the pre-erected or preformed partition 44. The preforming operation includes forming the double fold, or under-fold, of the horizontal web portion 54 along hinge line 76, to thereby form the double layer thickness, as shown in FIGS. 3 and 4. In this preformed condition however, that portion of the partition 44 which forms the vertical web 52, and the bottom flange 48, remain in a flattened condition of the blank as shown in FIG. 1. The flange 48 is at this time, with the blank flat, adhesively sealed to the interior surface of the bottom panel 22.

When the blank reaches the user, the container is fully erected or formed for reception of articles or bottles B (shown in dashed line outline in FIGS. 3 and 4). The erected position of the partition 44 is shown in FIGS. 2–4. When erected, the vertical web 52 is appropriately intermediatey positioned between the erected front and rear panels 38, 34. The foldable tabs and flaps 84, 88 are inwardly bent about their respective fold lines. The side panels 26, 28 are raised to an outwardly juxtaposed position with respect to tabs and flaps 84, 86. The in-folded end flaps 86 are then folded over the upper edges of the tabs 84 and all of the mated surfaces are adhesively sealed. The bottles B are then inserted through the open top of the carton into the holding and positioning openings, as shown, formed by the cutout tabs 58 and the double fold circular cutouts 74. The placement of the bottles in the two rows is shown in FIGS. 3 and 4.

The vertical web 52, the double thickness portion formed along hinge line 76 of the horizontal web portion 54, the engagement of the tabs 58 with the bottles, and the contacting engagement between the straight edges 72 of the tabs 58 with the interior of the front panel 38 gives rigidity and strength to the carton. Positive positioning and safe maintenance of the articles or bottles B in the carton is provided.

Subsequent to placement of the bottles, the composite panel 30 is so positioned that top panel portion 32 can be folded so as to overlie the open top, and the front closure flap 34 can extend vertically downwardly in front of front panel 38. Locking tab 36 is inserted through a preformed slit 92, as shown in FIG. 4. The carton is now complete and ready for shipment to an ultimate purchaser.

While a single preferred form of the invention has been described in detail hereinabove and shown in the drawings, it is within the concept of the invention as to slightly modify the blank. Such a modified blank and carton may be for accomodating a single row of articles with that portion of the partition with the cutout tabs 38 being eliminated. The vertical web portion extends downwardy from a hinge line, similar to that at 76 in FIGS. 3 and 4, and terminates in a horizontally disposed bottom flange similar to the tab portion 48. This flange is adhesively secured to the bottom interior of the carton.

In summary, a single thickness sheet of foldable paperboard is provided with such configuration, including cutouts and score lines, as to be formed into a carton having an interior, centrally disposed article spacing partition 44. The various partition components each coact with one another and with other parts of the carton to provide a strengthened overall carton. The carton can be partially pre-assembled or preformed, while maintained in a flat shipping condition, and subsequently may be easily erected and completed by the ultimate user for placement of the articles therein.

In this disclosure, there is shown and described a preferred embodiment of the invention, but as aforementioned, it is to be understood that the invention is capable of use in various other combinations and environments and is capable of changes or modificatons within the scope of the inventive concept as expressed herein.

I claim:

1. An article carton formed from a single sheet blank of foldable material, and having in assembled form, a bottom panel, a rear panel, side panels and a partially open front panel, all said panels being respectively interconnected along fold lines, the assembled carton having an open top, a composite panel including a top panel portion and front closure flap hingedly attached to said rear panel, a composite article spacer and positioning partition member in the interior of said carton integrally formed with the carton, said partition member being configured to provide a plurality of horizontally spaced article spacing compartments in said carton, a vertical web portion on said partition member operatively engaged with said bottom panel at an intermediate location between said front and rear panels, said partition member being connected along a first fold line with said vertical web adjacent said intermediate location in said carton and a second fold line along said partially open front panel, said partition member and the vertical web thereof conjointly forming interior reinforcement means for said carton along the partially open front.

2. A carton as claimed in claim 1 wherein said blank for forming the erected carton is initially in a substantially flat configuration, said composite article spacer and positioning partition member comprising an extension forming said partially open front panel, said second fold line being between said front panel and said extension, said extension being foldable along said second fold line to a position superposed over the interior surface of said front panel with said blank in the initially erected configuration, and subsequently said extension being adapted to be hingedly rotated about said fold line to a raised position in said erected form of said carton as said front panel is vertically positioned.

3. A carton as claimed in claim 2 wherein said extension includes an intermediate hinged panel, said intermediate panel in the erected carton constituting the vertical web portion of said partition member, and the free end thereof being in engagement with said bottom panel.

4. A carton as claimed in claim 3, the cutouts in said partition member having cutout tabs therein being proximate said second fold line between said front panel and said extension and adapted for providing article spacing in said carton.

5. A carton as claimed in claim 4, said cutouts including first cutouts having a curvilinear shaped side edge adapted for engagement with the surface of a curvilinear shaped article placed in said carton, said tabs having straight edges, said tabs being foldably attached to said partition member along fold lines, one edge being engageable with the interior surface of said front panel with the carton in erected form and with articles inserted in the cutouts and depressing said tabs, thereby tending to further rigidify said front panel and strengthen said partition.

6. A carton adapted for containment of articles therein and formed from a single sheet blank of folded material, said carton comprising, in a final erected form, a bottom panel, a rear panel, side panels, a partially open front panel and an open top, said panels being interconected along fold lines in the blank, a composite panel including a top panel portion and front closure panel hingedly connected to the upper edge of said rear panel, and adapted for folding over and closing said open top of the carton and extending downwardly over and closing said partially open front panel, an interior article spacer and positioning partition, said partition including a horizontal web portion having a plurality of cutouts forming article spacing means in said carton and adapted for spacing and positioning of articles inserted in the carton, a vertical web portion on said partition means extending downwardly from said horizontal web portion and engaging the interior surface of said bottom panel, said horizontal and vertical web portions coacting jointly with one another and with inner surfaces of the carton to reinforce and strengthen the carton and article spacer and positioning partition, wherein said blank for forming the erected carton is initially in a substantially flat configuration, said article spacer and positioning partion comprising an extension forming said partially open front panel, a fold line between said front panel and said extension, said extension being foldable along said fold line to a position superposed over the interior surface of said front panel with said blank in the initially erected configuration, and subsequently said extension being adapted to be hingedly rotated about said fold line to a raised position in said erected form of said carton as said front panel is vertically positioned, wherein said extension includes an intermediate hinged panel, said intermediate panel in the erected carton constituting the vertical portion of said partition, and the free end thereof being in engagement with said bottom panel, the cutouts in said partition having cutout tabs therein being proximate said fold line between said front panel and said extension and adapted for forming said article spacing means in said carton, said cutouts including first cutouts having a curvilinear shaped side edge adapted for engagement with the surface of a curvilinear shaped article placed in said carton, said tabs having straight edges, said tabs being foldably attached to said horizontal web portion along fold lines, one edge being engageable with the interior surface of said front panel with the carton in erected form and with articles inserted in the cutouts and depressing said tabs, thereby tending to rigidify said front panel and strengthen said partition, said cutouts including second cutouts in said horizontal web protion in substantial alignment with and spaced from the first cutouts, said second cutouts being circular and with the centers thereof positioned along a fold line in said horizontal web portion, said horizontal web portion being folded to provide a double layer thickness and forming semicircular cutouts from the circles in the material when folded, and adapted for engagement with the surfaces of curvilinear shaped articles in said carton interposed between said cutouts and said rear panel of said erected carton.

7. A carton as claimed in claim 6 wherein said vertical web portion of said partition is formed along a fold line spaced from said circular cutouts, said vertical web portion extending downwardy from and along a line extending intermediate the first and second cutouts.

8. A carton as claimed in claim 7, said horizontal web portion of said partition having end cutouts at the opposite ends thereof adapted for engagement with external curved article surfaces inserted therebetween and the inner surfaces of the side panels of said erected carton.

* * * * *